US007018590B2

(12) United States Patent
Knight

(10) Patent No.: US 7,018,590 B2
(45) Date of Patent: Mar. 28, 2006

(54) REVERSE FLOW CATALYTIC MUFFLER

(75) Inventor: Glenn Knight, Pouch Cove (CA)

(73) Assignee: Environmental Control Corporation, St. John's (CA)

( * ) Notice: Subject to any disclaimer, the term of this patent is extended or adjusted under 35 U.S.C. 154(b) by 678 days.

(21) Appl. No.: 09/891,326

(22) Filed: Jun. 27, 2001

(65) Prior Publication Data

US 2003/0003030 A1 Jan. 2, 2003

(51) Int. Cl.
*F01N 3/28* (2006.01)
*B01D 53/34* (2006.01)

(52) U.S. Cl. ..... 422/180; 422/176; 422/177

(58) Field of Classification Search ..... 422/171, 422/177, 176, 180; 60/299, 301, 302; 181/264, 181/268

See application file for complete search history.

(56) References Cited

U.S. PATENT DOCUMENTS

| | | | | |
|---|---|---|---|---|
| 3,577,728 A | | 5/1971 | Brimer et al. | 60/303 |
| 3,613,359 A | | 10/1971 | Posh et al. | 60/305 |
| 3,712,065 A | | 1/1973 | Hurst | 60/274 |
| 3,729,936 A | | 5/1973 | De Palma et al. | 60/274 |
| 3,823,555 A | | 7/1974 | Cole | 60/274 |
| 3,832,443 A | * | 8/1974 | Hass | 422/177 |
| 3,857,458 A | | 12/1974 | Ohtani et al. | 181/262 |
| 3,910,770 A | | 10/1975 | Kobylinski et al. | 422/172 |
| 3,918,918 A | | 11/1975 | Kohn et al. | 422/191 |
| 3,929,420 A | | 12/1975 | Wood | 422/171 |
| 3,948,810 A | | 4/1976 | Hervert | 502/100 |
| 3,957,445 A | | 5/1976 | Foster | 422/171 |
| 3,982,396 A | | 9/1976 | Suzuki | 60/282 |
| 3,994,364 A | | 11/1976 | Nicoll | 181/238 |
| 4,008,570 A | | 2/1977 | Harada | 60/229 |
| 4,094,645 A | | 6/1978 | Bailey | 422/180 |
| 4,197,704 A | | 4/1980 | Date et al. | 60/322 |
| 4,206,177 A | | 6/1980 | Otsubo et al. | 422/171 |
| 4,209,493 A | | 6/1980 | Olson | 422/176 |
| 4,231,221 A | | 11/1980 | Mathner et al. | 60/319 |
| 4,321,240 A | | 3/1982 | Robinson | 423/210 |
| 4,393,652 A | | 7/1983 | Munro | 60/295 |
| 4,420,933 A | | 12/1983 | Kajitani et al. | 60/302 |
| 4,541,240 A | | 9/1985 | Munro | 60/295 |
| 4,559,776 A | | 12/1985 | Arai et al. | 60/280 |
| 4,601,168 A | | 7/1986 | Harris | 60/299 |
| 4,797,263 A | | 1/1989 | Oza | 422/176 |
| 4,894,987 A | | 1/1990 | Harwood et al. | 60/299 |
| 4,916,897 A | | 4/1990 | Hayashi et al. | 60/286 |
| 5,016,438 A | | 5/1991 | Harris | 60/299 |

(Continued)

FOREIGN PATENT DOCUMENTS

| | | |
|---|---|---|
| FR | 2226865 | 11/1974 |
| WO | WO97/43528 | 11/1997 |

*Primary Examiner*—Hien Tran
(74) *Attorney, Agent, or Firm*—Gowling Lafleur Henderson LLP; Peter Milne

(57) ABSTRACT

A catalytic muffler having a housing with a first chamber and a second chamber fluidly communicating through a catalyst bed interspersed there between. A first baffle assembly in the first chamber extends between the catalyst bed and the housing. An inlet passage extends through the housing into the first chamber. An outlet passage extends through the housing into one of the first and second chambers. A second baffle assembly in the second chamber extends between the catalyst bed and the housing. The first and second baffle assemblies act in conjunction with the housing and the reactor bed to define a flow passage through the housing from the inlet passage through at least three discreet zones of the reactor bed to the outlet passage.

15 Claims, 6 Drawing Sheets

U.S. PATENT DOCUMENTS 5,043,147 A 8/1991 Knight ..... 422/180
5,062,263 A 11/1991 Carboni ..... 60/299
5,103,641 A 4/1992 Maus et al. ..... 60/299
5,134,849 A 8/1992 McWhorter ..... 60/304
5,138,834 A 8/1992 Maund et al. ..... 60/276
5,150,573 A 9/1992 Maus et al. ..... 60/299
5,185,998 A 2/1993 Brew ..... 60/299
5,220,789 A 6/1993 Riley et al. ..... 60/302
5,338,903 A 8/1994 Winberg ..... 181/231
5,431,013 A 7/1995 Yamaki et al. ..... 60/289
5,548,955 A 8/1996 Sandefur et al. ..... 60/299
5,578,277 A * 11/1996 White et al. ..... 422/180
5,732,555 A 3/1998 Gracyalny et al. ..... 60/299
6,159,429 A * 12/2000 Bemel ..... 422/177

* cited by examiner

REVERSE FLOW CATALYTIC MUFFLER

FIELD OF THE INVENTION

This invention relates generally to engine exhaust handling apparatus, and more particularly, to apparatus for noise abatement and catalytic treatment of internal combustion engine exhaust gasses.

BACKGROUND OF THE INVENTION

In the burning of petroleum fuels in an internal combustion engine, hydrocarbons in the fuel and nitrogen and oxygen from the air used to combust the fuel combine to yield various oxides and nitrides, principally comprising carbon monoxide, carbon dioxide, nitrous oxide and nitric oxide. Waste materials in the fuel, such as sulphur produce other oxides such as sulphur dioxide. Additionally, some of the fuel passes into the exhaust partially combusted or uncombusted.

Often the particular oxides are more harmful to human beings than other oxides of the same elements. For example carbon dioxide may pose less of a hazard than carbon monoxide. In order to minimize the more harmful emissions, most larger internal combustion engines, particularly those used in automobiles are equipped with exhaust gas catalysts in their exhaust systems ("catalytic converters") to convert less desirable oxides to more desirable oxides.

Automobiles generally have a fair amount of space available for both a catalytic converter and for noise abatement apparatus such as a muffler and a resonator to suppress the noise ordinarily associated with internal combustion engine operation.

Smaller engines in applications such as lawnmowers are significant generators of pollutants but in the past have seldom if ever been equipped with exhaust treatment apparatus, despite that for their size they often generate proportionately more harmful emissions. A reason for this may be the lack of expensive and sophisticated engine management systems found in more expensive applications such as automobiles.

It is an object of the present invention to provide a catalytic muffler of compact dimensions which is easily accommodated in small displacement internal combustion engine applications.

It is a further object of the present invention to provide such a compact catalytic muffler which also has noise attenuation capabilities to obviate the need for a separate muffler.

It is also an object of the present invention to provide a noise abating catalytic muffler design for small engine applications which is simple and comparatively inexpensive to produce and which lends itself readily both to O.E.M. and retrofit applications.

SUMMARY OF THE INVENTION

A catalytic muffler having a housing with a first chamber and a second chamber fluidly communicating through a catalyst bed interspersed there between. A first baffle assembly in the first chamber extends between the catalyst bed and the housing. An inlet passage extends through the housing into the first chamber. An outlet passage extends through the housing into one of the first and second chambers. A second baffle assembly in the second chamber extends between the catalyst bed and the housing. The first and second baffle assemblies act in conjunction with the housing and the reactor bed to define a flow passage through the housing from the inlet passage through at least three discreet zones of the reactor bed to the outlet passage.

The inlet and outlet passages may extend through the first chamber, either through an end of the first chamber or a side of the first chamber as desired. Alternatively, the inlet passage may extend into the first chamber and the outlet passage may extend into the second chamber.

The reactor bed may include an oxidizing catalyst in one part thereof and a reducing catalyst in another part thereof.

The reducing catalyst may be upstream of the oxidizing catalyst.

The housing may be cylindrical.

DESCRIPTION OF DRAWINGS

Preferred embodiments of the invention are described in detail below with reference to the accompanying figures in which:

FIG. 5 is an end elevation of the right side of the catalytic muffler of

FIG. 1;

DESCRIPTION OF THE PREFERRED EMBODIMENTS

Figure 1:
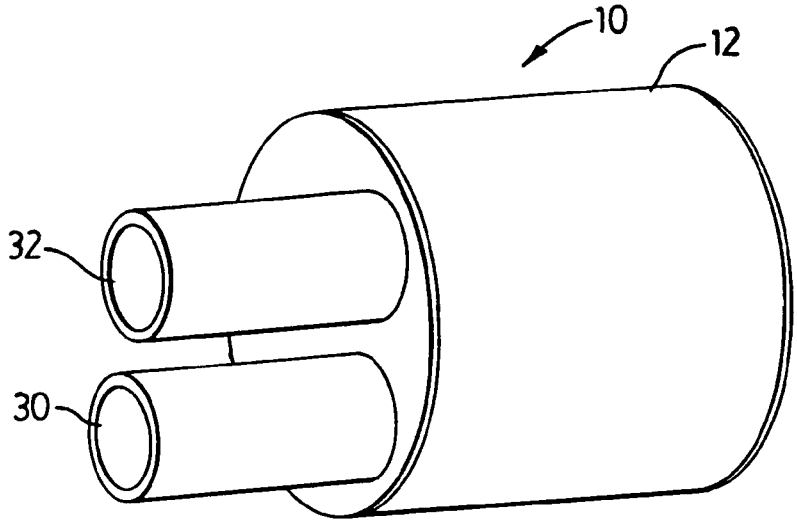
FIG. 1 is perspective view of a catalytic muffler according to the present invention.

A catalytic muffler according to the present invention is generally indicated by reference 10 in the accompanying illustrations. The catalytic muffler 10 is illustrated as having a generally cylindrical housing 12 however it will be appreciated that other shapes of housing might also be utilized.

The housing 12 has a first chamber 14 at one end thereof, and, a second chamber 16 at the opposite end. A reactor bed 18 occupies the space between the first chamber 14 and the second chamber 16. The reactor bed 18 may be a catalyst bearing ceramic (or possibly other) substrate having a honeycomb like configuration with a plurality of discreet flow passages 20 extending longitudinally therethrough. Accordingly, the first and second chambers, 14 and 16 respectively, fluidly communicate with each other through the reactor bed 18.

Figure 8A:
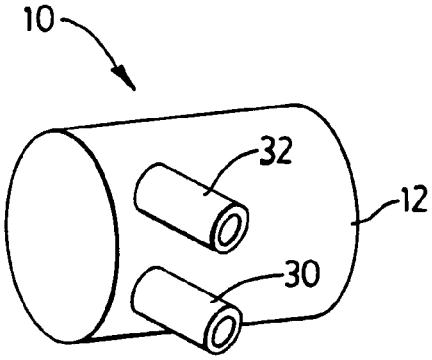
FIG. 8A is a perspective view of another alternate embodiment of a catalytic muffler according to the present invention having a side inlet and a side outlet; and, FIG. 9 is an exploded view of an alternate embodiment catalytic muffler according to the present invention.
Figure 8:
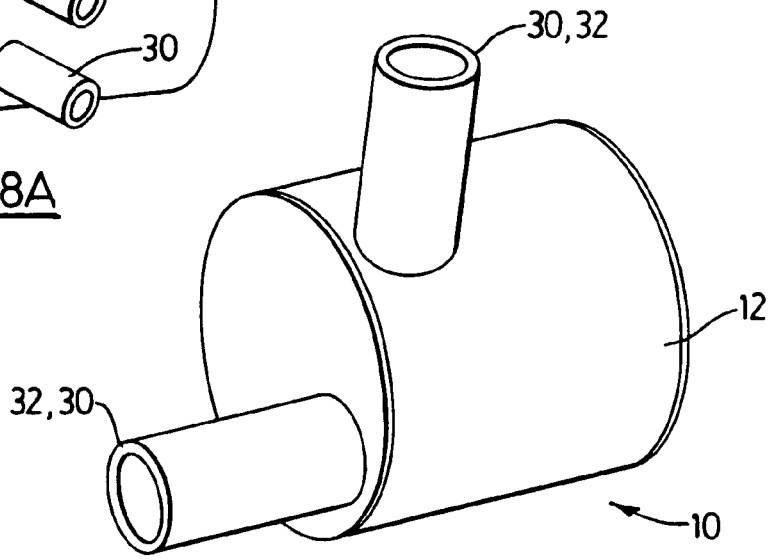
FIG. 8 is a perspective view of an alternate embodiment of a catalytic muffler according to the present invention having an end inlet and a side outlet.
Figure 9:
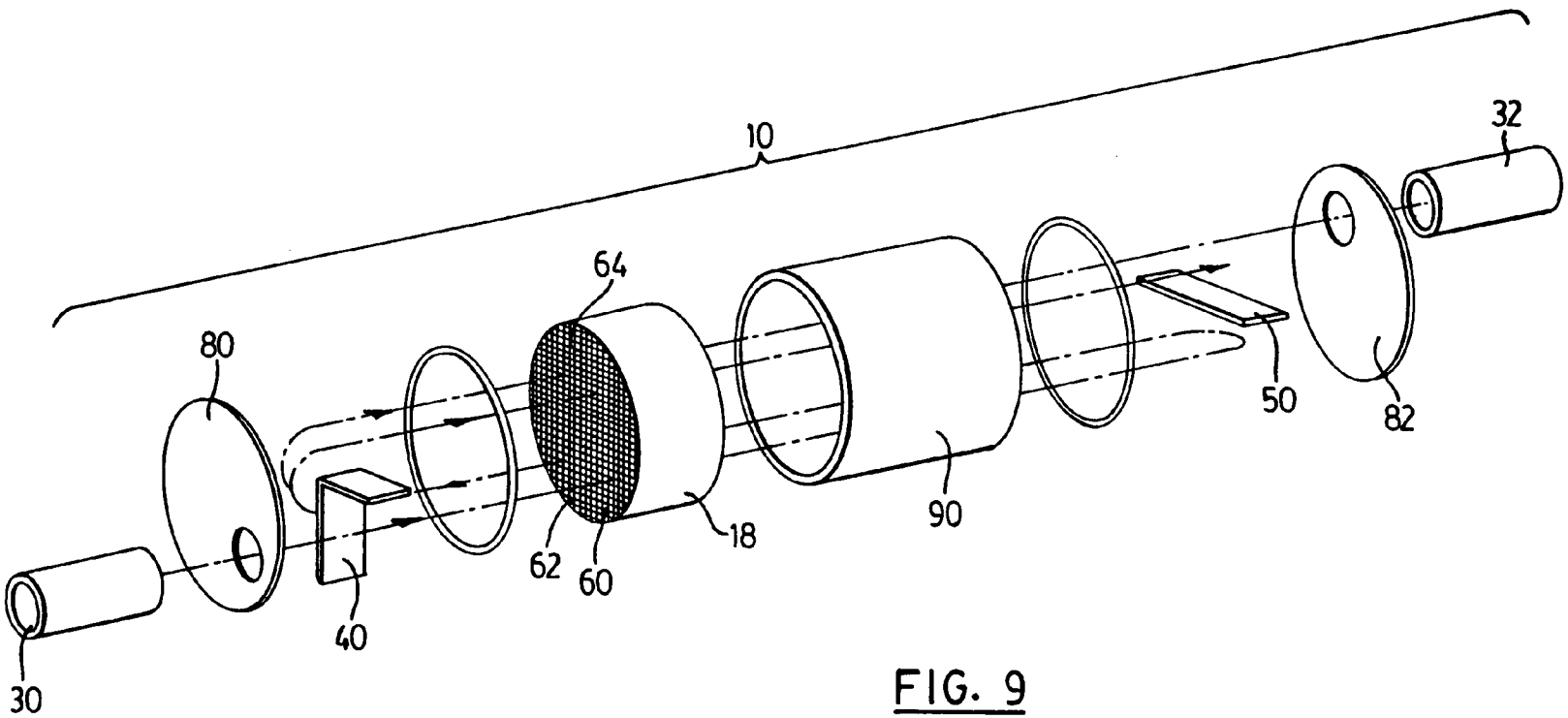

An inlet passage 30 extends through the housing 12 into the first chamber 14. Depending on the application, the inlet passage may extend into either a side (FIG. 8) or an end of the housing. Also depending on the application, the inlet passage may have various configurations and include such arrangements as a threaded opening and a tubular elbow. The specific configuration chosen will generally depend on the exhaust system configuration and availability of space in the intended application.

An outlet passage 32 may extend either from the first chamber 14 or the second chamber 16. The outlet passage 32 may extend either from a side or an end of the housing 12. As with the inlet passage 30, the location and configuration of the outlet passage 32 will generally depend on the parameters associated with the intended application.

A first baffle assembly 40 is housed within the first chamber 14. The first baffle assembly 40 is a member with a generally T-shaped configuration. The member extends between the housing 12 and the reactor bed so as to divide the first chamber 14 into first, second and third parts, 42, 44 and 46 respectively. The first part 42 and the third part 46 each represent about one fourth (¼) of the volume of the first chamber 14. The third part represents about one half (½) of the volume of the first chamber 14.

A second baffle assembly 50 is housed within the second chamber 16 and extends between the housing 12 and the reactor bed 18 to divide the second chamber into first and second parts 52 and 54 respectively. The first part 52 and the second part 54 are of roughly equal volume.

The first baffle assembly 40, second baffle assembly 50, housing 12 and reactor bed 18 cooperate to define a flow passage through at least first, second and third discreet zones, 60, 62 and 64, respectively, of the reactor bed 18.

Gas is therefore directed to flow from the inlet passage 30 into the first part 42 of the first chamber 14, through the first zone 60, through the first part 52 of the second chamber 16, through the second zone 62 of the reactor bed 18 into the second part 44 of the first chamber 12 and through the third zone 64 of the reactor bed into the second part 54 of the second chamber 16. If the outlet passage 32 communicates with the second part 54 of the second chamber 18, gas will be discharged therethrough.

If the outlet passage 32 communicates with the third part 46 of the first chamber 14, gas will flow from the second part 54 of the second chamber 16 through a fourth zone 66 of the reactor bed, into the third part of the first chamber 14 and out through the outlet 32. In this latter embodiment, gas will flow four times through the reactor bed 18 albeit through a different zone each time. In the former embodiment, gas will flow three times through the reactor bed 18, through a different zone each time.

The reactor bed 18 may itself be made up of more than one section and one section may bear an oxidizing catalyst with another section bearing a reducing catalyst. It is expected that the catalytic muffler 10 will be more effective if the reducing section is upstream of the oxidizing section, for example, if the first zone 60 and second zone 62 promote reduction and the third zone 64 and fourth zone 66 (if there is a fourth zone) promote oxidation.

Figure 2A:
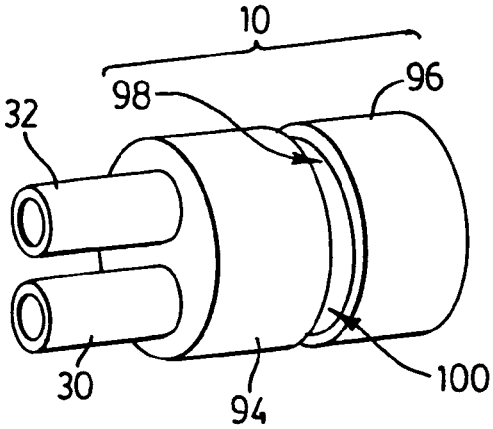
FIG. 2A is a partially exploded view of a catalytic converter according to FIG. 2 showing an alternate housing design.
Figure 2B:
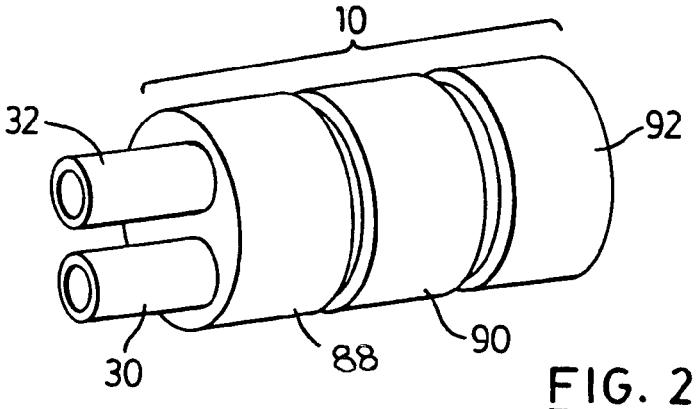
FIG. 2B is a partially exploded view of yet another embodiment for the housing of the catalytic converter of FIG. 2.
Figure 2:
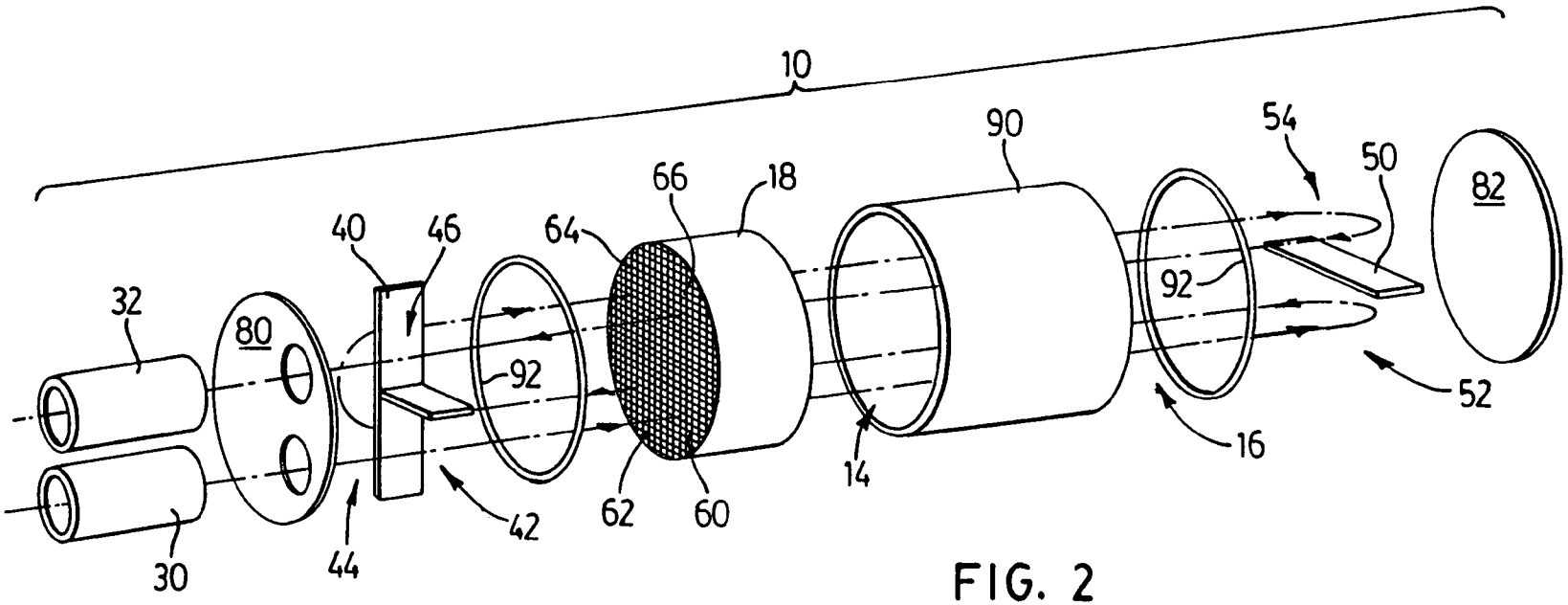
FIG. 2 is an exploded perspective view corresponding to FIG. 1.
Figure 3:
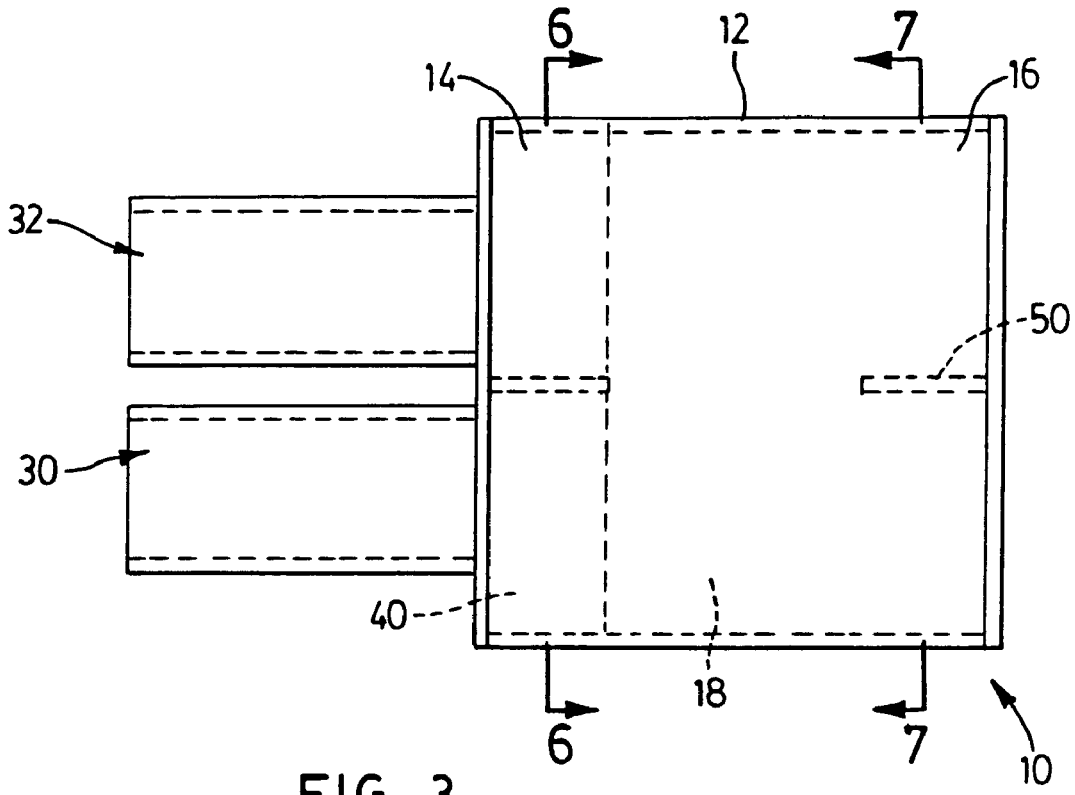
FIG. 3 is an elevational view of the catalytic muffler of FIG. 1.
Figure 4:
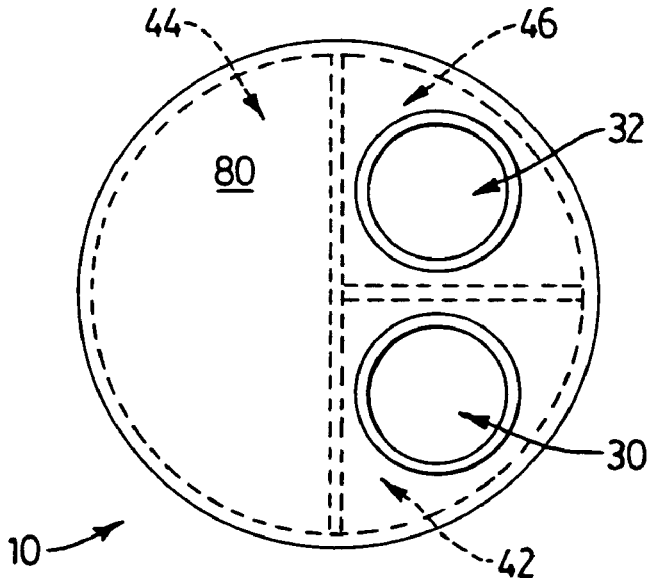
FIG. 4 is an end elevation of the left side of the catalytic muffler of FIG. 1.
Figure 5:
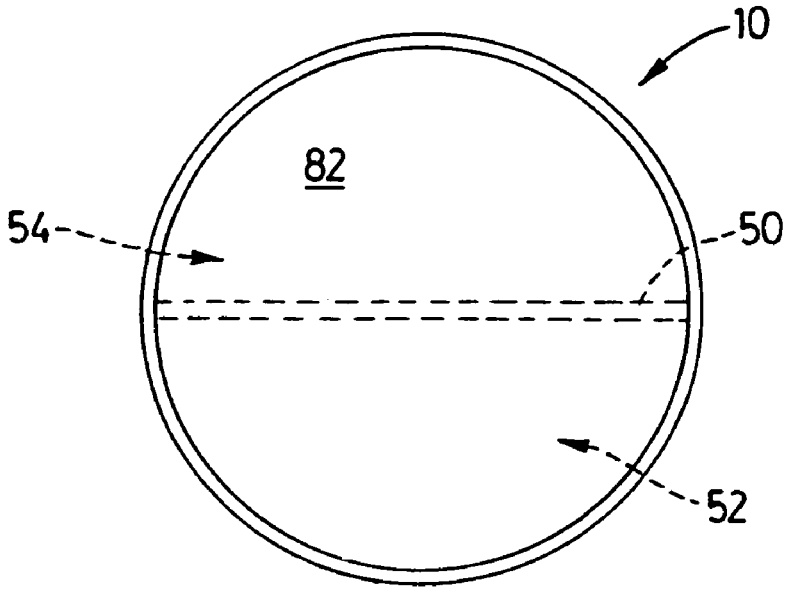
Figure 6:
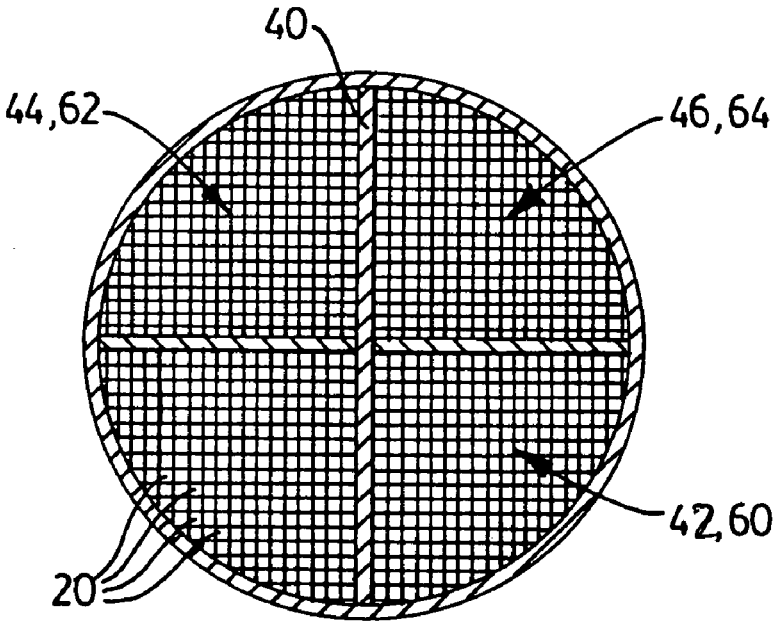
FIG. 6 is a section on line 6—6 of FIG. 3.
Figure 7:
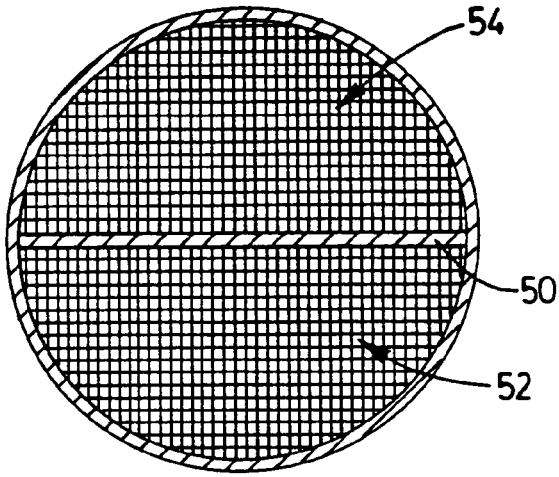
FIG. 7 is a section on line 7—7 of FIG. 3.

One manner of configuring the catalytic muffler 10 is illustrated in the exploded view of FIG. 2. The housing 12 is made up of first and second disc-shaped parts 80 and 82 which may be joined at respective outer edges to a sleeve 90. The first baffle member or assembly 40 may be generally P-shaped, or alternatively, T-shaped and act as a spacer to locate the reactor bed 16 within the housing 12. The second baffle member or assembly 50 may be rectangular or alternatively, generally D-shaped and act as a further spacer to locate the reactor bed 18 within the housing 12. Retainer rings 92 may also be provided to engage the interior of the sleeve 90 to locate the reactor bed 18.

Alternatively, as illustrated in FIG. 2B the housing 12 may be in three parts with a first cup-shaped part 88 and second cup-shaped part 92 capping opposite ends of the sleeve 90.

As yet a further alternative, the housing may be made up of first and second cup-shaped parts 94, 96 respectively which may be joined at respective outer edges 98 and 100.

The above description is intended in an illustrative rather than a restrictive sense. Variations to the exact structures described may be apparent to those skilled in such structures without departing from the spirit and scope of the present invention as defined by the claims set out below.

What is claimed is:

1. A catalytic muffler comprising:

a housing having a first chamber, and a second chamber fluidly communicating through a catalyst bearing reactor bed interspersed therebetween; said reactor bed having a first face facing directly into said first chamber, a second face facing directly into said second chamber and a plurality of discrete flow passages extending longitudinally therethrough between said first and second faces to provide direct fluid communication between said first and second chambers;

a first baffle assembly extending longitudinally through said first chamber between said first face of said catalyst bed and said housing to longitudinally partition said first chamber;

an inlet passage extending through said housing into said first chamber;

an outlet passage extending through said housing into one of said first chamber and said second chamber;

a second baffle assembly extending longitudinally through said second chamber between said second face of said catalyst bed and said housing to longitudinally partition said second chamber;

said first and second baffle assemblies acting in conjunction with said housing and said reactor bed to define a flow passage through said housing from said inlet passage to said outlet passage requiring at least three sequential passes through said reactor bed directly between said first and second chambers with each subsequent of said passes being through a discrete, laterally adjacent zone of said reactor bed and opposite in direction to an immediately preceding of said passes.

2. A catalytic converter as claimed in claim 1 wherein:

one of said inlet and said outlet passages extends through an end of said housing;

the other of said inlet and said outlet passages extends through a side of said housing.

3. A catalytic converter as claimed in claim 1 wherein:

said inlet and said outlet passages extend through a side of said housing.

4. A catalytic converter as claimed in claim 1 wherein:

said inlet and outlet passages extend through an end of said housing.

5. A catalytic converter as claimed in claims 2, 3 or 4 wherein:

said housing is cylindrical.

6. A catalytic converter as claimed in claims 2, 3 or 4 wherein:

said reactor bed includes an oxidizing catalyst in one part thereof and a reducing catalyst in another part thereof.

7. A catalytic converter as claimed in claim 6 wherein:

said housing is cylindrical, said reactor bed is made up of sections with said oxidizing catalyst and said reducing catalyst bearing parts corresponding to different of said sections.

8. A catalytic converter as claimed in claim 4 wherein:

said inlet passage extends into said first chamber;

said outlet passage extends into said second chamber.

9. A catalytic muffler as claimed in claim 8 wherein:

said reactor bed includes an oxidizing catalyst as one part thereof and a reducing catalyst in another part thereof.

10. A catalytic muffler as claimed in claim 9 wherein:

said reducing catalyst is upstream of said oxidizing catalyst.

11. A catalytic muffler as claimed in claim 10 wherein:

said housing is cylindrical.

12. A catalytic muffler as claimed in claim 6 wherein:

said reducing catalyst is upstream of said oxidizing catalyst.

13. A catalytic muffler as claimed in claim 12 wherein:

said housing is cylindrical, said reactor bed is made up of sections with said oxidizing catalyst and said reducing catalyst bearing parts corresponding to different of said sections.

14. A catalytic muffler as claimed in claim 1 or 2 wherein:

said housing is cylindrical and defined by cup shaped first and second parts joined at respective outer edges; and, said first and second baffle members act as spacers to locate said reactor bed within said housing.

15. A catalytic muffler as claimed in claim 1 or 2 wherein:

said housing is cylindrical and made up of cup shaped first and second parts, joined at respective outer edges to respective ends of a sleeve; and, said first and second baffle assemblies act as spacers to located said reactor bed within said housing.

* * * * *